United States Patent [19]
Hoët
[11] 4,229,674
[45] Oct. 21, 1980

[54] GRID OF PYROLYTIC GRAPHITE FOR A HIGH-POWER ELECTRON TUBE AND A METHOD FOR THE ASSEMBLY OF SAID GRID

[75] Inventor: Roger Hoët, Paris, France
[73] Assignee: Thomson-CSF, Paris, France

[21] Appl. No.: 49,126
[22] Filed: Jun. 18, 1979
[30] Foreign Application Priority Data
Jun. 23, 1978 [FR] France ..... 78 18834
[51] Int. Cl.[3] ..... H01J 1/46; H01J 9/14
[52] U.S. Cl. ..... 313/348; 313/349; 313/356; 313/352; 29/25.14; 29/25.15
[58] Field of Search ..... 313/348, 349, 356, 352; 29/25.14, 25.15

[56] References Cited
U.S. PATENT DOCUMENTS
3,800,378 4/1974 Lee et al. ..... 313/348 X
4,119,880 10/1979 Wilcox et al. ..... 313/349 X

*Primary Examiner*—Alfred E. Smith
*Assistant Examiner*—Charles F. Roberts
*Attorney, Agent, or Firm*—Roland Plottel

[57] ABSTRACT

A thin-walled grid of pyrolytic graphite for a high-power electron tube such as a triode or tetrode has a lower end in the form of a bell-shaped sleeve provided with uniformly spaced longitudinal slots which stop short of the edge of the sleeve. The solid edge portion thus formed beneath each slot serves to fit the sleeve over a metal ring of the electron tube base. The grid sleeve is clamped against the metal ring by means of screws engaged in internally-threaded bores of the ring. The edge portions of the graphite sleeve are thus fractured so as to form longitudinal strips which compensate for differences in expansion between the graphite and the metal while ensuring good electrical contact.

6 Claims, 8 Drawing Figures

GRID OF PYROLYTIC GRAPHITE FOR A HIGH-POWER ELECTRON TUBE AND A METHOD FOR THE ASSEMBLY OF SAID GRID

This invention relates to electron tubes in which provision is made for at least one grid of pyrolytic graphite.

In more exact terms, the invention is directed to a method of assembly of a grid of this type as well as to machined grids for the practical application of said method.

The advantages offered by grids of pyrolytic graphite (also known as oriented graphite) are well known and have been described in particular in a number of patents filed by the present Applicant. French Pat. Nos. 1,344,220 and 1,523,248 can be mentioned by way of example.

Grids of this type have found a very extensive industrial application in the manufactures of the present Applicant. They have led to the development of novel structures, especially of emission triodes in which it had previously been a conventional practice to make use of metal grids. The grid structure consisted in particular of support columns of large diameter for the finer wires which were woven between the columns and formed the square mesh of the grid.

Grids of pyrolytic graphite are usually designed in the shape of thin-walled cylindrical bells, the lower ends of which are fixed on a metal ring within the vacuum tube. The use of these grids presents a particularly difficult problem, however, since three essential conditions have to be satisfied, viz:

a high standard of accuracy and high geometrical undeformability in order to ensure both accuracy and constancy of the cathode-grid spacing on which the perveance depends;

elastic absorption, without any misalignment, of the difference in expansion between the graphite and the metal of the connecting ring which is of molybdenum, for example;

flow of current without any high-frequency loss.

This problem is solved in a simple manner by means of the method according to the invention, which essentially consists in forming longitudinal slots at the lower end of the grid so as to leave wide strips between the slots which, in accordance with the invention, do not open on the bottom edge but stop short of the edge. Holes are pierced in the grid at the lower ends of the strips thus formed. The grid which has been prepared in this manner is fitted over the metal ring and clamped in position at points located at uniform intervals around said ring by means of screws engaged in internally-threaded bores formed opposite to said holes. The graphite retaining portions which remain at the ends of the slots are fractured under the clamping action.

After assembly, the base of the grid is thus divided into a number of strips each securely fixed and spaced at a distance corresponding to the width of the slots, with the result that any difference in expansion between graphite and metal can be absorbed by said strips without any resultant stress or misalignment.

The accuracy of assembly is not affected since the bottom edge of the grid is solid at the moment of assembly. Furthermore, good rigidity is ensured in the axial direction since the slots are of small width.

Finally, excellent electrical contact is maintained and is comparable with that of a conventional assembly without slots.

The grids which are intended to be mounted in accordance with the invention are characterized by a series of longitudinal slots, the lower ends of which are located at uniform intervals and terminate at a short distance from the edge of the grid. The height of graphite remaining beneath the end of each slot is just sufficient to ensure rigidity of the edge prior to assembly and sufficiently small to cause the slots to form an opening in the bottom edge by fragmentation of said retaining portions at the time of clamping of the grid.

A more complete understanding of the invention will be gained from the following description and from the accompanying drawings, wherein.

It is a known practice to split-up an element into a plurality of smaller elements in order to prevent rupture of said element under the action of thermal stresses.

Experiments carried out by the Applicant have shown, however, that a grid of oriented graphite having a lower end element or base which has been cut so as to form strips cannot be employed directly since residual internal stresses in the graphite body act in a direction such that the partial stress relief which takes place at the time of formation of the slots has a constricting effect on the lower end of the grid. In consequence, the internal diameter at the ends of the strips is reduced to such an extent that these latter are abuttingly applied against the ring whereas an easy fit had previously been possible. It accordingly becomes necessary to complete the assembly operation by bending the strips outwards one after the other, thus exposing them to the danger of fractures which would make the grid unserviceable.

The invention is precisely based on the observation that, if the strips are simply started by means of slots instead of being completely cut in the lower end of the grid and if the slots do not have openings on the edge but terminate at a point very close to the edge, positioning of the grid no longer presents any particular problem. All the advantages of a base cut to the edge are still provided after assembly by reason of the fact that graphite retaining portions which had remained beforehand at the ends of the slots are broken away at the time of clamping in position.

Figure 1:
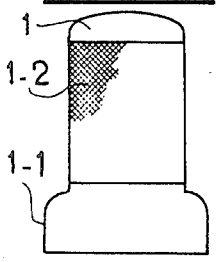
FIG. 1 (*a,b,c,d*) shows the different steps of the method of assembly according to the invention.
Figure 1:
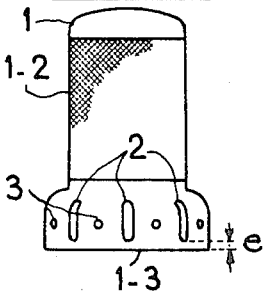
Figure 1:
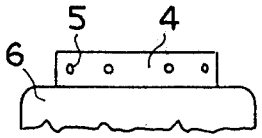

The method under consideration is illustrated in FIG. 1 in which the grid of a high-power electron tube is shown very diagrammatically and designated by the reference numeral 1. The grid is designed in the shape of a bell having a thin wall of pyrolytic graphite of uniform thickness. By way of example, the sand jet process described in French Pat. No. 1,523,248 is employed in order to machine the useful portion 1.2 of the grid, that is to say the portion located on the electron path. The grid is mounted on a metal ring which is shown in FIG. 1(*c*) and forms part of the electron tube. The design function of the ring is to maintain the tube in position as well as to establish an electrical contact with this latter by means of the flared sleeve 1.1.

The method according to the invention essentially consists of three steps:

(1) Machining of the sleeve 1.1 of the grid 1 shown in FIG. 1(*a*). During this initial step, there are formed in said sleeve by any known means, on the one hand uniformly spaced longitudinal slots 2 which do not open on the bottom edge 1.3 of the grid and, on the other hand, uniformly spaced holes 3 between the slots (the figure shows only a single hole between two slots but it will prove advantageous in practice to utilize two or more holes in order to ensure better position-maintenance in the axial direction).

The distance e between the lower end of the slot and the edge 1.3 is of the order of 0.5 mm, for example, in respect of a sleeve thickness of the order of 0.5 mm. The grid thus obtained is shown diagrammatically in FIG. 1(*b*);

(2) Machining of the ring 4 which is pierced with internally threaded bores 5 shown in FIG. 1(*c*) and corresponding to the holes 3 of the grid;

(3) The assembly operation proper which consists in fitting the sleeve 1.1 shown in FIG. 1(*b*) over the metal ring 4 which is mounted on the base 6 of the electron tube and in clamping the sleeve against the ring by means of screws (not shown in the drawings).

During this operation, the portions of graphite which are located beneath the slots and have a height e are broken away and, after clamping, the slots 2 open on the edge 1.3 as shown in FIG. 1(*d*).

Steps (1) and (2) can be carried out in any order or at the same time if a double drilling rig is available.

Machining of the slots 2 as well as the holes 3 can be performed by any known means. The upper end of the slot, namely the end remote from the edge 1.3, is rounded in order to prevent any incipient rupture on this side of the slot. The slots could advantageously be formed by machining in accordance with the method employed for the portion 1.2. Since the degree of accuracy required in this case is considerably lower than in the portion 1.2, this machining operation is much faster.

Figure 2:
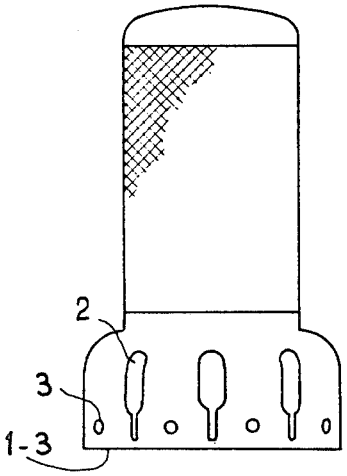
FIGS. 2 and 3 show respectively two alternative designs of grids of pyrolytic graphite which are machined for the practical application of the method according to the invention.
Figure 1:
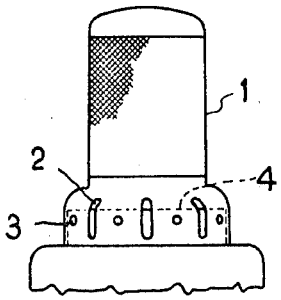
Figure 4:
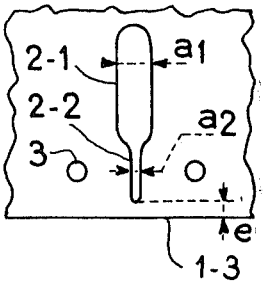
FIGS. 4 and 5 are enlarged fragmentary views of the grids of FIGS. 2 and 3 respectively.

FIGS. 2 and 4 show a first preferred shape of the slots 2. Two portions can be distinguished in these figures: an upper portion 2.1 of greater width having a rounded upper end and a lower portion 2.2 having a smaller width corresponding to that of a saw-cut (this portion can be formed by sawing, although it may also prove more advantageous in this case to form it by the sand-jet machining process).

It can be noted by way of example, and not in any limiting sense, that a grid fabricated in accordance with the invention has the following dimensions:

width of slots: $a_1=3$ mm; $a_2=0.5$ mm
height of upper portion of slot: 14 mm
height of lower portion: 2 mm
height of graphite portions at lower end of slot: $e \approx 0.5$ mm
distance between slot axes: 11 mm
thickness of sleeve: $\approx 0.5$ mm
external diameter of sleeve: $\approx 112$ mm
diameter of upper portion of grid: 90 mm
height of grid: 200 mm.

In this example, the upper portion of the slot is joined to the lower portion of a convex shouldered portion having a radius of curvature substantially equal to that of the upper portion of the slot and having a height of approximately 1.5 mm.

Figure 3:
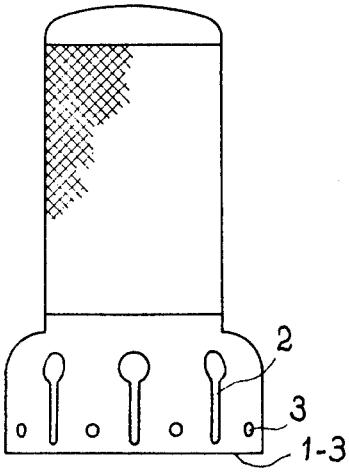
Figure 5:
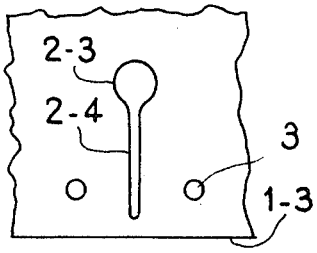

Another alternative shape of slot is shown in FIGS. 3 and 5. In this example, a keyhole slot is formed by a thin saw-cut 2.4, the upper end of which opens into a circular hole 2.3. This type of slot can be formed by any known means, by drilling in the case of the portion 2.3 followed by sawing of the portion 2.4, although the sand-jet machining process can again prove particularly advantageous in this instance.

The invention is primarily applicable to high-power triodes and tetrodes for radio and television transmitters.

What is claimed is:

1. A method of assembly of a cylindrical electron-tube grid of pyrolytic graphite, the lower end of said grid being formed by a thin-walled sleeve which is intended to be mounted on a metal ring, wherein said method consists of the following steps, the first two of which can be carried out in any order or at the same time, viz:

machining of longitudinal slots which are located at uniform intervals around the periphery of said graphite sleeve and terminate at a short distance from the edge of said sleeve but do not open on said edge, and machining of fixing holes between said slots;

machining of fixing bores in said metal ring, said bores being internally threaded and adapted to correspond to the holes of said grid;

fitting of said grid over said ring and fixing of said grid on said ring by means of screws engaged and tightened within said bores.

2. An electron tube grid of pyrolytic graphite which is intended to be mounted on a metal ring, the lower end of said grid being formed by a thin-walled cylindrical sleeve, wherein the sleeve is provided with a series of longitudinal slots located at uniform intervals around the periphery of said sleeve as well as a series of fixing holes located at uniform intervals between said slots, said slots being adapted to terminate at a short distance from the edge of said sleeve so as to leave a retaining portion of small height between the ends of said slots and said edge.

3. An electron tube grid according to claim 2, wherein said slots terminate in a rounded profile at the ends remote from the edge of said sleeve.

4. An electron tube grid according to claim 2, wherein each slot is of greater width in the portion which is remote from the edge of said sleeve than in the portion which is adjacent to said edge.

5. An electron tube grid according to claim 4, wherein the portion of greater width of each slot is circular.

6. An electron tube grid according to claim 4 wherein each slot is constituted by two longitudinal portions.

* * * * *